US008221555B2

(12) United States Patent
Classen

(10) Patent No.: US 8,221,555 B2
(45) Date of Patent: Jul. 17, 2012

(54) DISHWASHER MACHINE WITH A SOUND WAVE GENERATOR AND RELEVANT METHOD

(75) Inventor: Egbert Classen, Wertingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 713 days.

(21) Appl. No.: 11/634,724

(22) Filed: Dec. 5, 2006

(65) Prior Publication Data

US 2007/0131250 A1 Jun. 14, 2007

(30) Foreign Application Priority Data

Dec. 8, 2005 (DE) ..... 10 2005 058 663

(51) Int. Cl.
*B08B 3/00* (2006.01)

(52) U.S. Cl. ..... 134/25.2; 134/18; 134/25.3; 134/30; 134/31; 134/42; 134/56 D; 134/57 D; 134/58 D

(58) Field of Classification Search ..... 134/18, 134/25.2, 25.3, 30, 31, 42, 56 D, 57 D, 58 D
See application file for complete search history.

(56) References Cited

U.S. PATENT DOCUMENTS

| | | | | |
|---|---|---|---|---|
| 3,709,732 | A * | 1/1973 | Thomen | 134/57 D |
| 3,854,998 | A | 12/1974 | Jacobs | |
| 5,218,980 | A * | 6/1993 | Evans | 134/68 |
| 2003/0084535 | A1 * | 5/2003 | DuVal et al. | 15/339 |
| 2005/0072449 | A1 * | 4/2005 | Alpert et al. | 134/25.1 |
| 2005/0081895 | A1 * | 4/2005 | Miyauchi et al. | 134/58 D |
| 2005/0268668 | A1 * | 12/2005 | Miyauti et al. | 68/3 R |
| 2006/0076037 | A1 * | 4/2006 | Kim et al. | 134/10 |
| 2007/0056610 | A1 * | 3/2007 | Lee et al. | 134/25.3 |

FOREIGN PATENT DOCUMENTS

| | | | |
|---|---|---|---|
| DE | 44 44 147 | | 6/1996 |
| DE | 103 26 438 | | 12/2004 |
| DE | 103 53 774 | | 2/2005 |
| JP | 2004081707 | * | 3/2004 |
| WO | WO 91/01473 | | 2/1991 |

OTHER PUBLICATIONS

Encyclopedia2. The free dictionary.com, p. 1, Jan. 10, 2011, definition of ultrasonic generator.*
National Search Report DE 10 2005 058 663.5.

* cited by examiner

*Primary Examiner* — Bibi Carrillo
(74) *Attorney, Agent, or Firm* — James E. Howard; Andre Pallapies

(57) ABSTRACT

A dishwasher machine (1), in particular a domestic dishwasher machine, is described, comprising a washing container (2) and devices for washing items to be washed by means of washing solution, as well as a sound wave generator (5), wherein the sound wave generator (5) is used to generate a sound wave which at least assists the drying process of the items to be washed. In order to achieve the highest possible efficiency of the drying process, the sound wave generator (5) is designed to deliver sound waves of different frequency and/or amplitude.

23 Claims, 1 Drawing Sheet

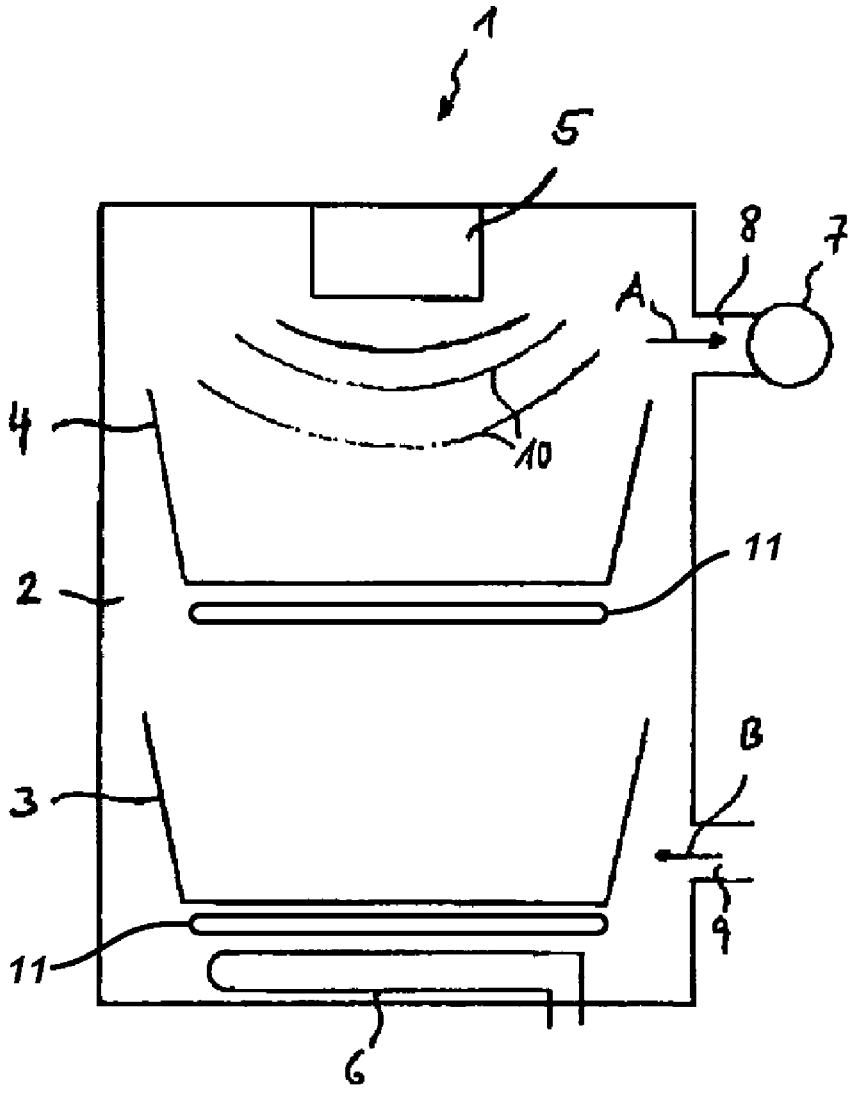
1
5
8
7
A
4
10
11
2
B
3
9
11
6

DISHWASHER MACHINE WITH A SOUND WAVE GENERATOR AND RELEVANT METHOD

BACKGROUND OF THE INVENTION

The invention relates to a dishwasher machine, in particular a domestic dishwasher machine, comprising a washing container and devices for washing items to be washed by means of washing solution, a control device, at least one wash program comprising the partial program steps "clean", "intermediate rinse", "clear rinse" and "dry" and comprising a sound wave generator for acting upon the interior of the washing container (2) with sound waves. The invention further relates to a method for cleaning items to be washed in a washing container of a dishwasher machine, in particular a domestic dishwasher machine, comprising the partial program steps "clean", "intermediate rinse", "clear rinse" and "dry" and wherein the interior of the washing container is acted upon by sound waves.

Conventional dishwasher machines are known to comprise a washing method whose program sequence generally consists of a partial program step "pre-wash", a partial program step "clean", at least one partial program step "intermediate rinse", a partial program step "clear rinse" and a partial program step "dry".

Various drying systems are known for drying the items to be washed in a dishwasher machine. For example, so-called condensation drying is used in which the items to be washed are heated to high temperature, usually 65° C., in a partial program step preceding the "dry" partial program step in order to evaporate the moisture as a result of the high temperature of the items to be washed (self-heat of the items to be washed) and/or the washing container. However, this procedure has the disadvantage that a considerable quantity of energy must be expended to heat the items to be washed. In addition, there are drying systems provided with a fan which circulates the air in the washing container and dries this circulated air outside the washing container e.g. as a result of condensation on cold surfaces and then preferably re-heats this air again before returning it into the washing container.

In addition, so-called sorption drying devices are known from DE 103 53 774 A1 of the applicant in which moist air is guided from the washing container onto a reversibly dehydratable material which extracts the moisture from the moist air. Since the moisture absorption capacity of the reversibly dehydratable material is limited, the reversibly dehydratable material is regenerated at a different point in time from the drying process. Compared with condensation drying, this method has the advantage that the drying of the items to be washed requires a considerably lower expenditure of energy. A disadvantage, however, is the somewhat more complex design of the dishwasher machine since additional components and lines must be provided in an area located outside the washing container.

Known from U.S. Pat. No. 3,854,998 is a dishwasher machine provided with an ultrasonic generator which acts upon the washing solution used to clean the items to be washed with ultrasonic vibration to enhance the cleaning performance. As a result of the design-dependent generation of ultrasonic vibration using water vapour and hot air which is intended to set in vibration the washing solution emerging from the washing device, the ultrasonic wave generator cannot be used for other purposes. In addition, the design configuration does not allow the use of dishwasher machines conventionally used nowadays in which two washing devices each allocated a holder for items to be washed are provided.

In addition, WO 91/01473 discloses an ultrasonic drying device, among other things for drying crockery. This comprises a power amplifier and/or an oscillator circuit, a transducer and a device for transmitting or focussing the ultrasonic waves. The sound wave can be generated using a compressed air source or an ultrasonic whistle.

SUMMARY OF THE INVENTION

It is the object of the present invention to provide a dishwasher machine and a method for operating a dishwasher machine which achieve an enhanced drying performance whilst using a sound wave generator to dry items to be washed.

In the dishwasher machine according to the invention, this is achieved whereby the sound wave generator can be operated during the "dry" partial program section to generate sound waves which at least assist the drying process of the items to be washed.

The invention is based on the idea that sound waves, in particular sounds, produce a pattern on a liquid surface. In this case, the liquid surface behaves as a vibrating elastic membrane. This effect, which is also known under the term "Chladni's acoustic figures" can be used to intensify the drying performance in a dishwasher machine. The operation of a sound wave generator excites the liquid droplets of the washing solution adhering to the items to be washed and/or the washing container so that they vibrate. These vibrations reduce the adhesion of the liquid droplets, in particular on oblique or perpendicular surfaces so that the liquid droplets can run off from the items to be washed and/or the washing container. The moisture can thus be extracted from the items to be washed and/or the washing container without using thermal energy, so that the energy requirement during the "dry" partial program section can be reduced substantially.

Depending on the size and configuration of the liquid adhering to the items to be washed and/or the washing container, a different frequency and amplitude of the sound source can be necessary to excite vibration. This circumstance can be taken into account by designing the sound wave generator to deliver sound waves of different frequency and/or amplitude so that improved drying can be achieved by improved draining behaviour of the items to be washed.

It is particularly advantageous if the sound wave generator according to one embodiment is driven by a control device is such a manner that sound waves having a predefined spectrum of frequencies and/or amplitudes are generated during a "dry" partial program step. Since the necessary frequency and/or amplitude of the sound source is dependent on the type and size of the liquid droplets and the absorption of the carrier media, according to this embodiment, the sound source should run through a frequency spectrum which includes as many relevant frequencies as possible. As a result, many differently constructed liquid droplets are excited to vibrate and the adhesion to their carrier medium, the items to be washed and/or the washing container is reduced, thus promoting draining.

In order to facilitate the draining of the liquid droplets, according to a further embodiment it is provided that the devices for holding the items to be washed are designed in such a manner that said items to be washed occupy a substantially perpendicular or inclined position. This ensures that the largest possible number of oblique or perpendicular surfaces is provided on the items to be washed so that the liquid droplets can flow off downwards under the action of gravity.

In order to assist the drying effected by the sound wave generator, it can be appropriate to provide a heater for heating the washing solution and/or the items to be washed, which heater heats the washing solution and/or the items to be washed in a step preceding the "dry" partial program step. The washing solution and/or the items to be washed can be heated using a continuous-flow heater which is usually already provided, e.g. by heating the washing solution which acts upon the items to be washed in the "clear rinse" partial program step.

It can furthermore be appropriate to provide a fan which can be operated during the "dry" partial program step to assist the drying process. In this case, it is particularly preferred if the fan is operatively connected to the surroundings to that the moist air is released outside to the surroundings. Accordingly, a corresponding inlet opening must be provided in the washing container which allows the intake of dry air into the washing container. In addition, the air circulated by the fan can also be circulated in a closed cycle and the air can be dried either by a sorption drying device or by condensation at a colder surface.

The method according to the invention is associated with the same advantages as have been described hereinbefore in connection with the dishwasher machine.

In the method according to the invention for operating a dishwasher machine comprising at least one "dry" partial program step, during the "dry" partial program step according to the invention a sound wave generator is operated to apply sound waves into the interior of the washing container, in particular onto the items to be washed and/or onto the residual liquid adhering to the items to be washed in order to at least partially assist the drying process. The sound wave generator is preferably driven by a control device in such a manner that during this "dry" partial program step, said generator delivers sound waves of different frequency and/or amplitude.

The sound waves of different frequency and/or amplitude excite liquid droplets of different size and different configuration on different carrier media so that they vibrate, thereby reducing the adhesion of the liquid droplets on the carrier medium. This improves the drying of the items to be washed without an increased expenditure of energy.

The sound wave generator is preferably driven by the control device in such a manner that the sound wave generator generates sound waves having a predefined spectrum of frequencies and/or amplitudes during a "dry" partial program step. Running through a frequency spectrum should ensure that the largest possible number of liquid droplets is made to vibrate in order to thereby run of the items to be washed and/or the washing container.

It can furthermore be provided that the washing solution and/or the washing container are heated in a partial program step preceding the "dry" partial program step.

It is furthermore provided in a further embodiment that a fan is operated during the "dry" partial program step in order to convey moist air from the washing container and dry air into the washing container.

BRIEF DESCRIPTION OF THE DRAWINGS

The invention and its advantages are explained hereinafter in detail with reference to the single FIGURE.

DETAILED DESCRIPTION OF THE EXEMPLARY EMBODIMENTS OF THE PRESENT INVENTION

The FIGURE is a schematic diagram showing a dishwasher machine 1 according to the invention, in particular a domestic dishwasher machine 1, comprising a washing container 2 in which crockery baskets 3, 4 are arranged to accommodate items to be washed which are not shown. The dishwasher machine 1 comprises in a known fashion spray devices (not shown) which are allocated to the crockery baskets 3, 4 and which spray the items to be washed with washing solution.

The dishwasher machine 1 comprises a sound wave generator 5 located in the washing container 5 which is used to dry the items to be washed located in the washing container 2.

The sound wave generator 5 has an oscillation and transmission means 5*a* (see FIG. 2) for generating sound waves 10 which is not shown in detail. Sound waves of different frequency and amplitude can be generated by varying the oscillation frequency of the oscillation means. A control device, not shown, which controls the sound wave generator 5 controls said sound wave generator 5 in such a manner that this runs through a predetermined frequency spectrum in the course of the "dry" partial program section. This excites the liquid surface of differently configured liquid droplets on the items to be washed and/or on the walls of the washing container 2 so that they vibrate. Depending on the shape of a liquid droplet, its excitation is dependent on the frequency and amplitude of the sound wave produced as well as the material to which the liquid droplets adhere. By running through a frequency spectrum, it is possible to excite the largest possible number of liquid droplets adhering to the items to be washed and/or the walls of the washing container so that they vibrate, thereby reducing the adhesion to their carrier medium. Since the crockery baskets 3,4 usually hold the items to be washed in such a manner that a large number are provided on oblique or almost perpendicular surfaces, the liquid droplets set into vibration can flow downwards from their surface in the direction of gravity.

Depending on the length of operation of the sound wave generator and the scope of the generated frequency spectrum, it is possible to dry the items to be washed with only a low expenditure of thermal energy. However, the drying process can be assisted by heating the items to be washed, e.g. in the preceding "clear rinse" partial program step. For this purpose a heater 6 is located in the washing container to heat the washing solution. The heater 6 can be integrated in the water cycle of the dishwasher machine, e.g. in any manner and can, for example, be embodied as a continuous flow heater. However, the heater can also be embodied as an air heater which heats the moist air in the washing container 2 during the drying process. The drying method according to the invention is therefore preferably used in combination with drying methods known from the prior art in order to lower the energy consumption in the drying methods known from the prior art.

Since the moisture absorption capacity increases with increasing heating of the air, it is furthermore advantageous to provide a fan 7 which removes the moist air from the washing container 2 via an outlet 8 in the direction of flow A and dry air is fed into the washing container 2 via an inlet 9 in the direction of flow B. In particular, the invention could be combined with a sorption drying device such as described, for example, in DE 103 53 774 of the applicant.

With the present invention, a dishwasher machine of the type described can be operated economically, the items to be dried can be dried efficiently and the associated expenditure can be kept low.

Reference List

1 Dishwasher machine
2 Washing container
3 Crockery basket
4 Crockery basket
5 Sound wave generator

6 Heater
7 Fan
8 Outlet
9 Inlet
10 Sound wave
A Direction of flow
B Direction of flow

The invention claimed is:

1. A dishwasher machine comprising:

a washing container;

spray devices for spraying items to be washed with a washing solution; and a control device for controlling execution of at least one wash program having at least a partial program step of rinsing the items in the washing container and a partial program step of drying the items in the washing container that have previously been subjected to the partial program step of rinsing; and a sound wave generator for generating sound waves that travel within an interior of the washing container, the sound wave generator being operable during the partial program step of drying the items in the washing container to generate sound waves having a property that assists a drying process of the items, wherein the sound wave generator is a device discrete from the spray devices and operates independent of the spray devices, and wherein the sound wave generator generates sound waves having different frequencies and amplitudes.

2. The dishwasher machine according to claim 1, wherein the sound wave generator generates sound waves that act upon at least one of the items and on residual liquid that may adhere to the items.

3. The dishwasher machine according to claim 1, wherein the assembly includes devices for holding the items in the washing container and is operable to support the items in a selected one of a substantially perpendicular position and an inclined position in the washing container.

4. The dishwasher machine according to claim 1, comprising a heater, which is disposed in the washing container, for heating at least one of the washing solution and the items, the heater heating the respective washing solution and the items in a partial program step preceding the partial program step of drying the items in the washing container.

5. The dishwasher machine according to claim 1, comprising a fan, which conveys air into and out of the washing container via an outlet and an inlet of the washing container, operable during the partial program step of drying items in the washing container.

6. The dishwasher machine according to claim 1, wherein the sound wave generator is operable to generate sound waves that act upon at least one of the items and on residual liquid that may adhere to the items.

7. The dishwasher machine according to claim 1, wherein the sound wave generator generates the sound waves independent from a flow of a liquid and a vapor through the washing container or a heater of the dishwasher machine.

8. The dishwasher machine according to claim 1, wherein the sound wave generator is positioned on a top interior surface of the washing container to deliver sound waves downward onto the items in the washing container.

9. The dishwasher machine according to claim 1, wherein the sound wave generator generates a predetermined frequency spectrum and a predetermined amplitude spectrum of the sound waves during a course of the partial program step of drying the items.

10. The dishwasher machine according to claim 1, wherein the sound wave generator includes oscillation and transmission means for generating sound waves, and wherein the control device controls the sound wave generator such that the sound wave generator generates a predetermined frequency spectrum and a predetermined amplitude spectrum of the sound waves during a course of the partial program step of drying the items.

11. A method for cleaning items to be washed in a washing container of a dishwasher machine, the method comprising:

in a dishwasher machine having a washing container, spray devices for spraying the items with a washing solution, and a control device for controlling execution of at least one wash program having at least a partial program step of rinsing the items in the washing container, and a partial program step of drying the items in the washing container that have previously been subjected to the partial program step of rinsing, rinsing the items by spraying the items using the spray devices during the partial program step of rinsing the items in the washing container; and after rinsing the items, drying the items during a partial program step of drying the items which includes controlling a sound wave generator, which is a device that is discrete from the spray devices and that operates independent of the spray devices, wherein the sound wave generator generates sound waves having different frequencies and amplitudes that travel within an interior of the washing container, the sound waves having a property that assists a drying process of the items during the partial program step of drying the items.

12. The method according to claim 11 and further comprising heating the washing solution that subsequently contacts and correspondingly heats the items during a partial program step preceding the partial program step of drying the items in the washing container so that, via heating the items in the following partial program step of drying the items in the washing container, the items can be at least partially dried through their own heat.

13. The method according to according to claim 11, wherein the step of drying the items during the partial program step of drying the items includes operating a fan during the partial program step of drying the items in the washing container in order to convey a moist air away from the washing container and convey a dry air into the washing container.

14. The method according to claim 11, wherein the controlling the sound wave generator to generate the sound waves includes generating a predetermined frequency spectrum of the sound waves during a course of the partial program step of drying the items.

15. The method according to claim 11, wherein the controlling the sound wave generator to generate the sound waves includes generating a predetermined amplitude spectrum of the sound waves during a course of the partial program step of drying the items.

16. The method according to claim 11, wherein the controlling the sound wave generator to generate the sound waves includes generating a predetermined frequency spectrum and a predetermined amplitude spectrum of the sound waves during a course of the partial program step of drying the items.

17. The method according to claim 11, wherein the sound wave generator includes oscillation and transmission means for generating sound waves, and wherein the controlling the sound wave generator to generate the sound waves includes generating a predetermined frequency spectrum and a predetermined amplitude spectrum of the sound waves during a course of the partial program step of drying the items.

18. The method according to claim 13, wherein operating the fan includes at least one of operating the fan to effect circulation of air relative to a sorption drying device, which is in communication with the washing container, for drying of the air thereby and to effect circulation of air relative to a surface that is in communication with the washing container, the surface having a temperature that is cooler than a temperature of the circulated air so as to cause condensation of the air.

19. A dishwasher machine comprising:

a washing container;

spray devices for spraying items to be washed with a washing solution; and a control device for controlling execution of at least one wash program having at least a partial program step of rinsing the items in the washing container and a partial program step of drying the items in the washing container that have previously been subjected to the partial program step of rinsing; and a sound wave-generating drying device in the washing container that is operable to generate sound waves that travel within an interior of the washing container during the partial program step of drying the items, wherein the sound wave-generating drying device is operable to generate sound waves having a property that assists a drying process of the items, wherein the sound wave-generating drying device is a device discrete from the spray devices and operates independent of the spray devices, and wherein the sound wave generator generates sound waves having different frequencies and amplitudes.

20. The dishwasher machine according to claim 19, wherein the sound wave generator generates the sound waves independent from a flow of a liquid and a vapor through the washing container or a heater of the dishwasher machine.

21. The dishwasher machine according to claim 19, wherein the sound wave generator is positioned on a top interior surface of the washing container to deliver sound waves downward onto the items in the washing container.

22. The dishwasher machine according to claim 19, wherein the sound wave generator generates a predetermined frequency spectrum and a predetermined amplitude spectrum of the sound waves during a course of the partial program step of drying the items.

23. The dishwasher machine according to claim 19, wherein the sound wave generator includes oscillation and transmission means for generating sound waves, and wherein the control device controls the sound wave generator such that the sound wave generator generates a predetermined frequency spectrum and a predetermined amplitude spectrum of the sound waves during a course of the partial program step of drying the items.

* * * * *